US005371502A

United States Patent [19]

Dittmann

[11] Patent Number: 5,371,502

[45] Date of Patent: Dec. 6, 1994

[54] METHOD FOR THE ACTIVATION OF A MINE

[75] Inventor: Lutz Dittmann, Eckental-Eschenau, Germany

[73] Assignee: Diehl GmbH & Co., Nürnberg, Germany

[21] Appl. No.: 949,794

[22] Filed: Sep. 22, 1992

[30] Foreign Application Priority Data

Oct. 10, 1991 [DE] Germany ..... 4133543

[51] Int. Cl.[5] ..... G01S 13/86; F42C 14/08; F42C 13/04

[52] U.S. Cl. ..... 342/68; 342/28; 102/427

[58] Field of Search ..... 342/68, 28; 367/93, 367/94, 95, 96; 102/401, 427, 403, 416, 417, 418, 419, 420, 424, 425, 426

[56] References Cited

U.S. PATENT DOCUMENTS

| | | | |
|---|---|---|---|
| 3,836,949 | 9/1974 | Ergon | 367/95 |
| 3,877,377 | 4/1975 | Rabinow | 102/214 |
| 3,902,172 | 8/1975 | Weiss et al. | 342/53 |
| 4,030,420 | 6/1977 | Skagerlund | 244/3.19 X |
| 4,215,630 | 8/1980 | Hagelberg et al. . | |
| 4,308,537 | 12/1981 | Berry et al. | 356/5 X |
| 4,635,554 | 1/1987 | Palmer | 102/416 |
| 4,641,801 | 2/1987 | Lynch, Jr. et al. | 244/3.14 |
| 4,712,181 | 12/1987 | Dahlberg | 364/423 |
| 4,712,479 | 12/1987 | Babel | 102/427 |
| 4,712,480 | 12/1987 | Lindstadt et al. | 102/427 |
| 4,860,658 | 8/1989 | Lindstadt et al. | 102/427 |
| 5,001,985 | 3/1991 | Reid et al. | 102/427 |
| 5,187,322 | 2/1993 | Schloss et al. | 102/427 |
| 5,206,653 | 4/1993 | Westphal | 342/61 |

FOREIGN PATENT DOCUMENTS

| | | |
|---|---|---|
| 0418566 | 3/1991 | European Pat. Off. . |
| 0450118 | 10/1991 | European Pat. Off. . |
| 3543769 | 5/1990 | Germany . |
| 3837483 | 5/1990 | Germany . |
| 2240384 | 7/1991 | United Kingdom . |

*Primary Examiner*—John B. Sotomayor
*Attorney, Agent, or Firm*—Scully, Scott, Murphy & Presser

[57] ABSTRACT

A method for activating a mine possessing a specified activation radius; in particular an anti-helicopter mine, which is brought into an alarm condition by acoustic signals. In the alarm condition of the mine, an NLOS-radar is activated, through which the target speed and the target range of a helicopter are detected and the result of the detection is compared with the specified activation radius of the mine. Full activation of the mine is then implemented when the detection result is smaller than the activation radius, or a further or renewed NLOS-radar detection is effected when the detection result is greater than the activation radius of the mine.

2 Claims, 1 Drawing Sheet

METHOD FOR THE ACTIVATION OF A MINE

BACKGROUND OF THE INVENTION

1. Field of the Invention

The present invention relates to a method for the activation of a mine possessing a specified radius of activation; in particular, an anti-helicopter mine, whereby the mine is placed into an alarm or waking condition through the intermediary of acoustic signals.

2. Discussion of the Prior Art

The disclosure of German Laid-Open Patent Appln. 38 37 483 A1, which is assigned to the common assignee of this application, is directed to a mine having an active charge, which is orientable against a target by means of a tracking unit; especially against a slow-flying target, and which is actuatable by an acquisition-sensor circuit. This mine possesses an alarm sensor circuit which acoustically monitors a spatial angular sector. Moreover, this known mine incorporates an infra-red bearing sensor circuit which detects a target entering into the above-mentioned spatial angular sector with regard to its type, location and path of movement. For the operation of the tracking unit and for the operation of the mentioned circuits there is provided an energy supply which is uncoupled from the alarm-sensor circuit, the bearing sensor circuit and the tracking unit. The bearing sensor circuit couples the tracking unit to the energy supply only when there has been detected a suitable target traveling along a path which is suitable for the attacking thereof.

Copending U.S. patent appln. Ser. No. 07/889,455; filed on May 27, 1992, which is assigned to the common assignee of the present application, and the disclosure of which is incorporated herein by reference, discloses a sensor arrangement for an active body; in particular, for a land mine which is deployed against ground and airborne targets, including an alarm sensor which is responsive to the approach of a target, and incorporating circuit arrangement for the environmentally-adaptive setting of sensor-evaluating circuits for the release of the active mechanism for defending against or combatting the target. Hereby, at a low elevation above ground, there is provided at least one antenna for emitting an undirected electromagnetic ground wave and possibly also for receiving reflections of the environment upon the deployment of the active body; as well as, after activation by the alarm sensor, for determining the relative movement of a target which has penetrated into the previously encompassed environment or surroundings, on the basis of reflections from the target.

Copending U. S. patent appln. Ser. No. 07/891,392; filed May 29, 1992, which is assigned to the common assignee of this application, and the disclosure of which is incorporated herein by reference, describes a sensor arrangement for an active body; especially for a land mine deployed against ground and airborne targets, which includes an alarm sensor which is responsive to the approach of a target object, and with a memory storage for environmental or surroundings information obtained by means of a Non-Line of Sight radar (NLOS-radar). In that instance, in addition to the NLOS-radar which operates in a relatively low-frequency undirected mode with a range-dependently operating multiple-target extractor, there is provided a direction-finding or bearing base for obtaining directional information from the sensor arrangement to target objects. Hereby, there may be provided a plurality of high-frequency antennae or, in essence, a plurality of microphones as the target direction-finding or bearing base.

Further to the sensor arrangement as described hereinabove, pursuant to a further development in the above-mentioned sensor arrangement there is set forth in that U.S. patent application a concept in which the acoustic directional or bearing information should be as accurate as possible in order to again be able to derive therefrom range-finding or distance information. This is achieved with the foregoing arrangement in that the active body is equipped with at least three microphones, which in order to achieve a base configuration which is relatively large-in comparison with the base of the active body, are spaced from the active body, whereby one of the microphones can be located on the active body and the remaining microphones remain at all times connected to the active body.

SUMMARY OF THE INVENTION

Accordingly, it is an object of the present invention to provide a method for the activation of a mine possessing a specific activating radius; especially such as an anti-helicopter mine, whereby the mine is brought into an alarm or alerted waking condition through acoustic signals. The method enables the precise determination of the penetration of a helicopter which is to be combatted into the hemispherical detection region which is defined through the activating radius, so as to achieve an improvement with regard to the rate of encountered false alarms.

Through the method according to the invention, there are obtained the advantages that a line-of-sight (LOS) is not necessary for the detection of the target, in effect, for the detection of a helicopter which is to be combatted, and that an improvement is achieved with regard to the rate of encountered false alarms since the mine is only first fully activated when the target which is to be combatted; in essence, the helicopter which is to be attacked, is located within the detection region defined through the activation radius of the mine. From this there further results that, advantageously, there is no unnecessary consumption of energy caused by false alarms. Through the inventive combination of acoustic sensor structure for rough or approximate target angle detection and NLOS-radar, it is possible to advantageously facilitate a comparatively narrow and precise bounding or definition of the search area. From this, there advantageously results the possibility of an early orientation of the active component of the mine, or in effect, a rapid scanning or sweep over a given spatial angle sector. Furthermore, it is thereby possible to also provide for a multiple-target separation. The NLOS-radar can supply data with respect to the range to the target and target speed; for instance, for a passive target tracking or, respectively, tracking sensor.

It has also been found to be expedient when the mine is orientated towards a helicopter which is to be combatted, by means of a target-tracking sensor device which is operatively connected with the NLOS-radar.

A restriction in the target angle sector in elevation is possible when a suitable acoustic direction-finding or bearing base is employed for implementing the method of the invention. Hereby, it can more expediently relate to a tetrahedral direction-finding base. When utilizing such a tetrahedral acoustic direction-finding base, it is possible to restrict the target angle sector not only in azimuth but also with regard to elevation, so that the imposition of a tracking sensor device on the mine or, in essence, the active body thereof, is substantially simplified or curtailed.

Through the inventive method there becomes possible the combatting of low-flying helicopters which heretofore could not be attained through other combat media, inasmuch as low-flying helicopters usually only involve a short-term visual communication with the mine. That can be necessitated by the high speed of flight of the helicopter which is to be attacked, higher-growing vegetation or uneven terrain conditions in the vicinity of the mine. Hereby, the method according to the invention provides assistance in the form of simple means, whereby it is inventively possible to achieve a relatively early or timely activation of the mine, in which this activation can also entail an initial rough or approximate orienting of a target tracking or tracking sensor device, or in essence, of the active body of the mine.

BRIEF DESCRIPTION OF THE DRAWINGS

Further details, features and advantages of the inventive method are now described in detail hereinbelow, taken in conjunction with the accompanying drawings; in which.

DETAILED DESCRIPTION

Figure 1:
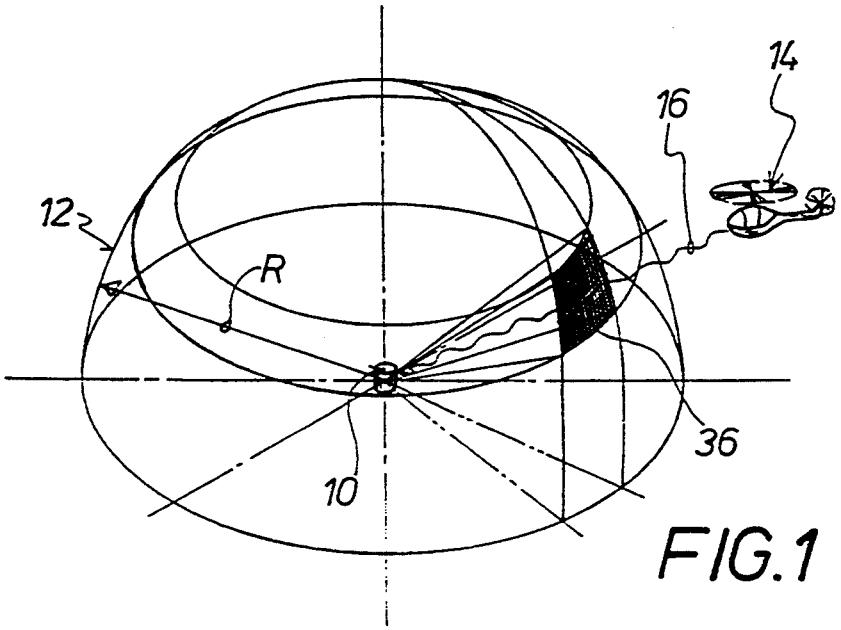
FIG. 1 illustrates a spatial representation of a mine with its activation radius or, in essence, its hemispherical detection region.
Figure 2:
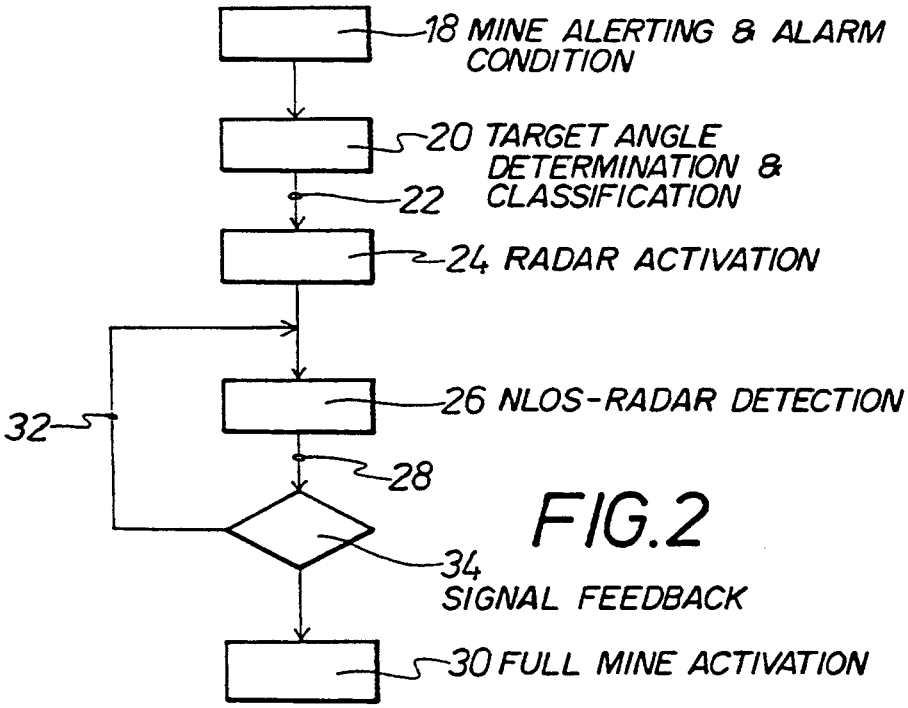
FIG. 2 illustrates a diagrammatic block representation of the flow chart of the inventive method for the activation of the mine for the attacking of a helicopter.

FIG. 1 shows a mine 10 which is positioned at a specified location, and which relates to an anti-helicopter mine. The mine 10 has a predetermined activation radius, which is designated by R. Through this activation radius R there is defined a hemispherical detection region 12 extending about the mine 10. Reference numeral 14 in FIG. 1 identifies a helicopter which is to be combatted, and which is located outside of the detection region 12. The helicopter 14 transmits acoustic signals of which a portion is emitted to the mine 10. This portion of the acoustic signals is indicated by the wavilinear arrow 16 in FIG. 1. The mine 10 is brought into an alerted or alarm condition by the above-mentioned acoustic signals (arrow 16). This is indicated in FIG. 2 by the block 18. With the mine 10 being in the alerted or alarm condition, through the acoustic signals which are emitted by the helicopter 14 (arrow 16) there is obtained a rough or approximate classification and determination of the target angle, as indicated in FIG. 2 by the block 20 which follows block 18. When the target angle determination is carried out with the aid of the acoustic signals, as is indicated by the arrow 22 in FIG. 2, then the NLOS-radar is activated, as is indicated by the block 24 in FIG. 2. A detection of the distance to the target and the target speed of the helicopter 14 which is to be combatted is then effected by means of the NLOS-radar, as indicated by the block 26 in FIG. 2. The result of this detection is indicated by the arrow 28. When the result of this detection (arrow 28 in FIG. 2) is smaller than the activation radius R (as shown in FIG. 1), there is then effected a full activation of the anti-helicopter mine 10, as indicated by the block 30 in FIG. 2. However, in the event that the result of this detection, as indicated by the arrow 28 relative to the distance to the target or target speed, is greater than the activation radius R, there will not take place a full activation of the mine (as indicated by the block 30), but a further or renewed NLOS-radar detection in accordance with block 26; in essence, a reconveyance or feedback from block 34 to block 26, as indicated by the arrow 32.

As already previously mentioned, through the combination of the acoustic sensor device and NLOS-radar, it is possible to achieve a restriction or narrowing in the search or target area and thereby an early or timely orienting or targeting of the active component of the mine, or essentially of the tracking sensor device; in effect, a fast scanning of a specified spatial angle 36 (as shown in FIG. 1). In the same manner, through the inventive method it is advantageously possible to implement a multiple-target separation.

What is claimed is:

1. A method for a two-stage activation of an anti-helicopter mine possessing specified outer and inner activation radii, said mine being equipped with a radar apparatus for determining the distance to an airborne target consisting of at least one helicopter and measurement of target movements, initiating a first stage of activation of said mine bringing said mine into an alarm condition through an acoustic direction-finding base upon said target entering said outer activation radius while still being outside of the inner activation radius for effecting the activation of a tracking device so as to initially orient the mine towards and tracking the movement of the acoustically-acquired target, in the alarm condition of the mine, initially activating only a non-line of sight radar (NLOS) in addition to the acoustic direction-finding base for the obtention of target distance and movement information when said target is at a distance from said mine which is between the outer and inner activation radii of said mine and implementing the second activation stage of said mine by placing said tracking device into function to effectuate the full activation of the mine only when the target subsequently comes within the inner activation radius of the mine to enable combatting said target with said mine.

2. A method as claimed in claim 1, wherein a predetermined acoustic direction-finding base limits the target angle sector in elevation, and said base is a tetrahedral acoustic bearing base.

* * * * *